US005651901A

United States Patent [19]

Mohri et al.

[11] Patent Number: 5,651,901

[45] Date of Patent: Jul. 29, 1997

[54] METHOD AND APPARATUS FOR SURFACE TREATMENT BY ELECTRICAL DISCHARGE MACHINING

[75] Inventors: Naotake Mohri, 661-51, Yagotoishizaka, Tenpaku-ku, Nagoya-shi, Aichi 468; Nagao Saito, Aichi; Takuji Magara, Aichi; Toshiro Ohizumi, Aichi, all of Japan

[73] Assignees: Mitsubishi Denki Kabushiki Kaisha, Tokyo; Naotake Mohri, Nagoya, both of Japan

[21] Appl. No.: 323,018

[22] Filed: Oct. 14, 1994

[30] Foreign Application Priority Data

Oct. 15, 1993 [JP] Japan ..... 5-258410

[51] Int. Cl.[6] ..... B23H 1/00

[52] U.S. Cl. ..... 219/69.17; 219/69.2

[58] Field of Search ..... 219/69.14, 69.2, 219/69.17, 69.15

[56] References Cited

U.S. PATENT DOCUMENTS

| | | | |
|---|---|---|---|
| 4,310,742 | 1/1982 | Pfau | 219/69.2 |
| 4,439,660 | 3/1984 | Inoue | 219/69.17 |
| 4,641,007 | 2/1987 | Lach | 219/69.2 |
| 4,948,625 | 8/1990 | Suzuki et al. | 427/580 |
| 5,189,276 | 2/1993 | Magara | 219/69.14 |
| 5,434,380 | 7/1995 | Magara et al. | 219/69.14 |

FOREIGN PATENT DOCUMENTS

| | | | |
|---|---|---|---|
| 0548932 | 6/1993 | European Pat. Off. . | |
| 4117620 | 12/1991 | Germany . | |
| 5748432 | 3/1982 | Japan . | |
| 62114876 | 5/1987 | Japan . | |
| 283119 | 3/1990 | Japan . | |
| 4210371 | 7/1992 | Japan . | |
| 5-93283 | 4/1993 | Japan | 427/580 |
| 5-106060 | 4/1993 | Japan | 427/580 |
| 5-179459 | 7/1993 | Japan | 427/580 |
| 1662781 | 7/1991 | U.S.S.R. | 219/69.15 |
| 1704971 | 1/1992 | U.S.S.R. | 219/69.15 |
| 1408944 | 10/1977 | United Kingdom | 219/69.2 |

*Primary Examiner*—Geoffrey S. Evans

*Attorney, Agent, or Firm*—Sughrue, Mion, Zinn, Macpeak & Seas

[57] ABSTRACT

A surface treatment method and apparatus therefor for providing wear and corrosion resistance, which includes relatively rotating a modified metallic member to be surface modified and a block, which may be metal only or may include a modifying material (e.g., ceramic or W-C/Co), and generating electrical discharge between the block and the modified metallic member to form a modification layer on the surface of said modified metallic member. If the modifying material is not in the block, it can be supplied via a dielectric bath or spray at the discharge interface. In this manner, the cutting edges of a cutting tool with a complicated shape can be surface modified easily to carry out tool surface treatment which increases a cutting tool life greatly. Cutting and surface treatment can be performed alternately as determined by a controller.

25 Claims, 12 Drawing Sheets

CUTTING AND EDM ARE CARRIED OUT IN THE SAME STEP
(EXAMPLE OF EDM SURFACE TREATMENT BY PRESSED POWER ELECTRODE)

CONTROL OF ELECTRIC DISCHARGE AND CUTTING

PROCESS OF SURFACE TREATMENT BY ELECTRICAL DISCHARGE BY PRESSED POWDER BLOCK

ELECTRIC DISCHARGE AFTER GRINDING
(EXAMPLE OF ELECTRIC SURFACE TREATMENT
BY MACHINING SOLUTION WITH POWDER)

ELECTRIC DISCHARGE AFTER GRINDING
(EXAMPLE OF ELECTRIC SURFACE TREATMENT
BY MACHINING SOLUTION WITH POWDER)

METHOD AND APPARATUS FOR SURFACE TREATMENT BY ELECTRICAL DISCHARGE MACHINING

BACKGROUND OF THE INVENTION

1. Field of the Invention

The present invention relates to a method and apparatus for surface treating a rotary cutting tool or the like by utilizing electrical discharge machining.

2. Description of the Background Art

A surface treating technique such as PVD and CVD is frequently used for treating a surface of cutting tools to coat the surface thereof with TiC, TiN and the like. On the other hand, with regard to a surface treating by way of electric discharge machining, a surface treating for a metal die has been proposed, but no surface treating or coating with regard to machining tools has been proposed. FIG. 12 shows a conventional method and apparatus for surface modification by electrical discharge machining reported in the past (for more information, see Masui et al., "Surface Alloying Treatment by Electrical Discharge Machining", Electrical Machining Technology, Vol. 16, No. 53 (1993)).

Referring to FIG. 12, a workpiece 1 to be surface modified is positioned proximate to an electrode 2 which is held by a spindle 3 that can be moved by a drive (not shown) in a vertical direction. The electrode 2 is disposed within a machining bath 4 which contains a dielectric 5 that includes modifying material powder. A machining power supply 6 provides energy for the machining process.

The following is a list of machining conditions:

Workpiece SKH51(61)
Electrode Copper (15×15 mm)
Dielectric Illuminating kerosine
Additive powder Impalpable tungsten powder
Grain diameter 1.3 μmicronmRmax.
adding amount 20 g/1000 ml illuminating kerosine
Open voltage 80(V)'
Peak current 2.5, 5, 10, 20(A)
Pulse width 5, 10, 20
Duty factor 0.3 (constant)

In operation, a pulse. voltage is applied between the workpiece 1 and the electrode 2 by the machining power supply 6 to generate electrical discharge. The electrode 2, together with the spindle 3, is servo driven by the drive (not shown) in the vertical direction (Z-axis direction) in the process of machining. Since the dielectric 5 includes impalpable powder of tungsten, electrical discharge causes the base metal of the workpiece 1 to be melted on the surface of the workpiece 1 and the tungsten powder in the dielectric 5 to enter the surface, whereby a modification layer, i.e., tungsten alloy layer, is formed on the workpiece 1 surface. Literature reports that a particularly even modification layer is provided by positive-polarity electrical discharge (electrode negative, workpiece positive). It is also known in the art that a similar modification layer is formed on a metal surface by electrical discharge machining using a dielectric including the powder of silicon, chrome or the like, offering high corrosion resistance and wear resistance.

As another similar method for forming a modification layer on a metal surface, Japanese Laid-Open Patent Publication No. HEI2-83119 discloses a method wherein a powder material for forming a surface layer is provided between an electrode and a workpiece to perform oscillatory electrical discharge machining. In this method, a material for forming a surface layer on the workpiece is provided in a machining gap as powder and oscillatory electrical discharge machining is conducted to prevent the powder of a substance used for surface treatment from fixing, whereby an even modification layer can be provided and the evenness of the machined material surface maintained.

SUMMARY OF THE INVENTION

A conventional method and apparatus for surface treatment by electrical discharge machining, which were designed as described above, allowed a modified material of simple shape to be surface treated but had difficulty in surface treatment of complicated shape. Especially in the surface treatment of a cutting tool, its cutting edges are complicated and depend greatly on a tool type. Hence, when an electrode is employed to surface treat a tool, it is necessary to manufacture an electrode of complicated shape according to the cutting edges of the tool or to program a complicated electrode moving track according to the cutting edge shape, requiring considerable labor and costs for electrode manufacturing, programming and machining techniques. Further, in general, with regard to the machining tools, the machining tools after using are usually subjected to grinding to refresh by a grinding machine. Since the above described PVD or CVD is relatively high in cost for arrangement, it is rare to reproduce the machining tool through the PVD or CVD.

It is accordingly an object of the present invention to overcome the problems of the conventional method and apparatus to form a modification layer on the cutting edges and other critical parts of a rotary cutting tool and to increase the life of the cutting tool. It is a further object to make it easy to replace the used machining tools.

DESCRIPTION OF THE PREFERRED EMBODIMENTS

Figure 1:
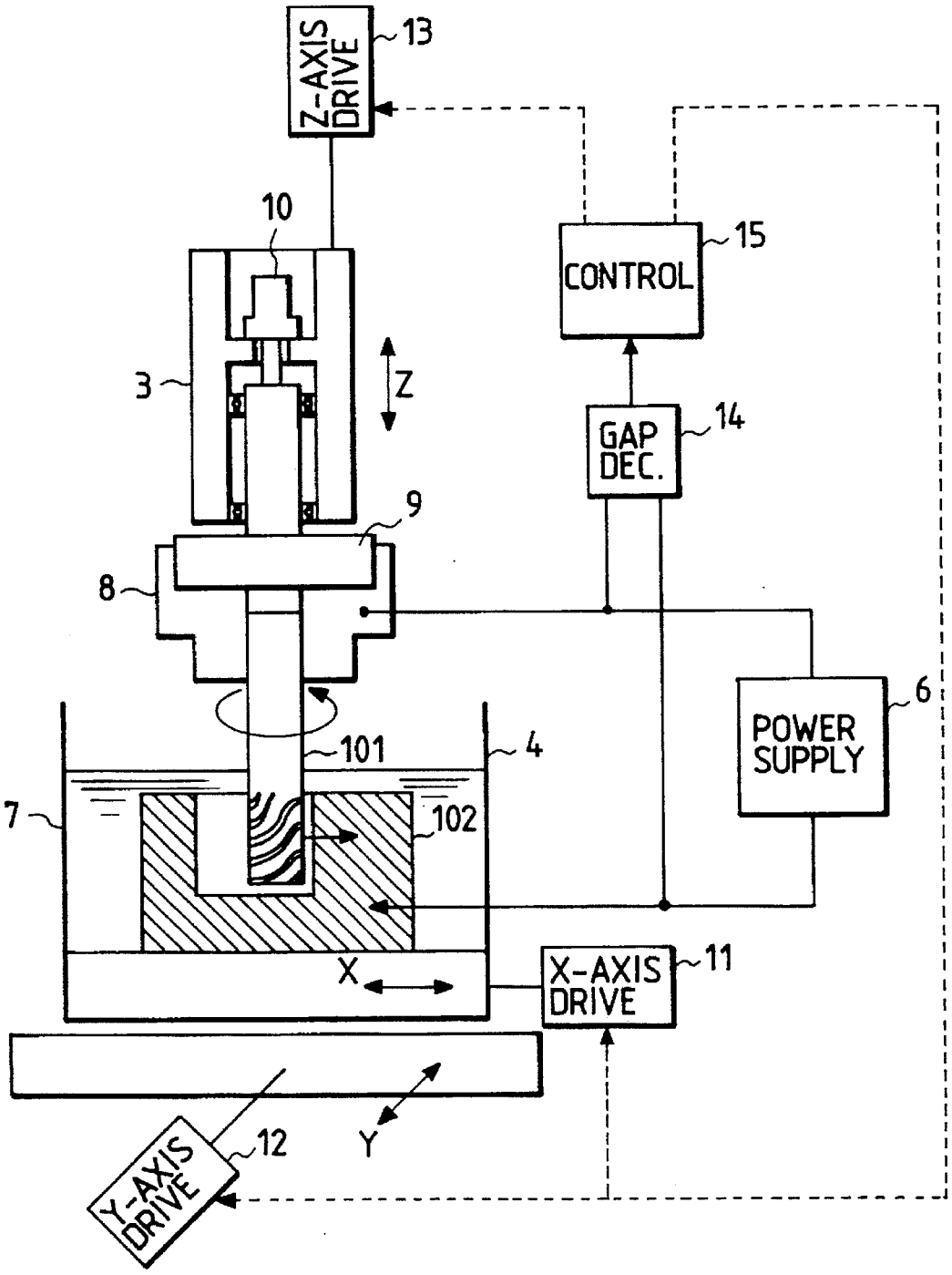
FIG. 1 is a diagram showing a first embodiment of the present invention.

Embodiment 1 of the present invention will now be described in accordance with FIG. 1. In this drawing, 101 indicates a rotary cutting tool (e.g., end mill, drill) to be surface treated and 102 designates a powder compact block which has been made by molding the powder of a modifying material, i.e., which has been made by sinter molding the powder of W-C (tungsten carbide) mixed with Co (cobalt) as the modifying material. 3 denotes a spindle which moves the rotary cutting tool 101 in the vertical direction (Z-axis direction), 4 represents a machining bath in which the powder compact block 102 is secured and which is filled with an electrical discharge machining dielectric, 6 indicates an electrical discharge machining power supply which applies a voltage between the rotary cutting tool 101 and the powder compact block 102, 7 indicates a dielectric, and 8 represents a chucking device, e.g., a three-way clamping automatic centering chuck, which holds the rotary cutting tool 101. 9 represents a rotating device which rotates the rotary cutting tool, 10 designates an electrode rotating motor which rotates the rotating device 9, 11 denotes an X-axis drive which drives the machining bath 4 together with the powder compact block 102 in an X direction, 12 indicates a Y-axis drive which drives the machining bath in a Y direction, 13 denotes a Z-axis drive which drives the spindle 3 together with the rotary cutting tool 101 in a Z direction (vertical direction), 14 represents a machining gap detector which detects a machining gap voltage or a short circuit between the rotary cutting tool 101 and the powder compact block 102, and 15 designates a control device which controls the relative travel speeds of the rotary cutting tool 101 and the powder compact block 102 according to the detection result of the machining gap detector 14.

Figures 2A, 2B, 2C, 2D:
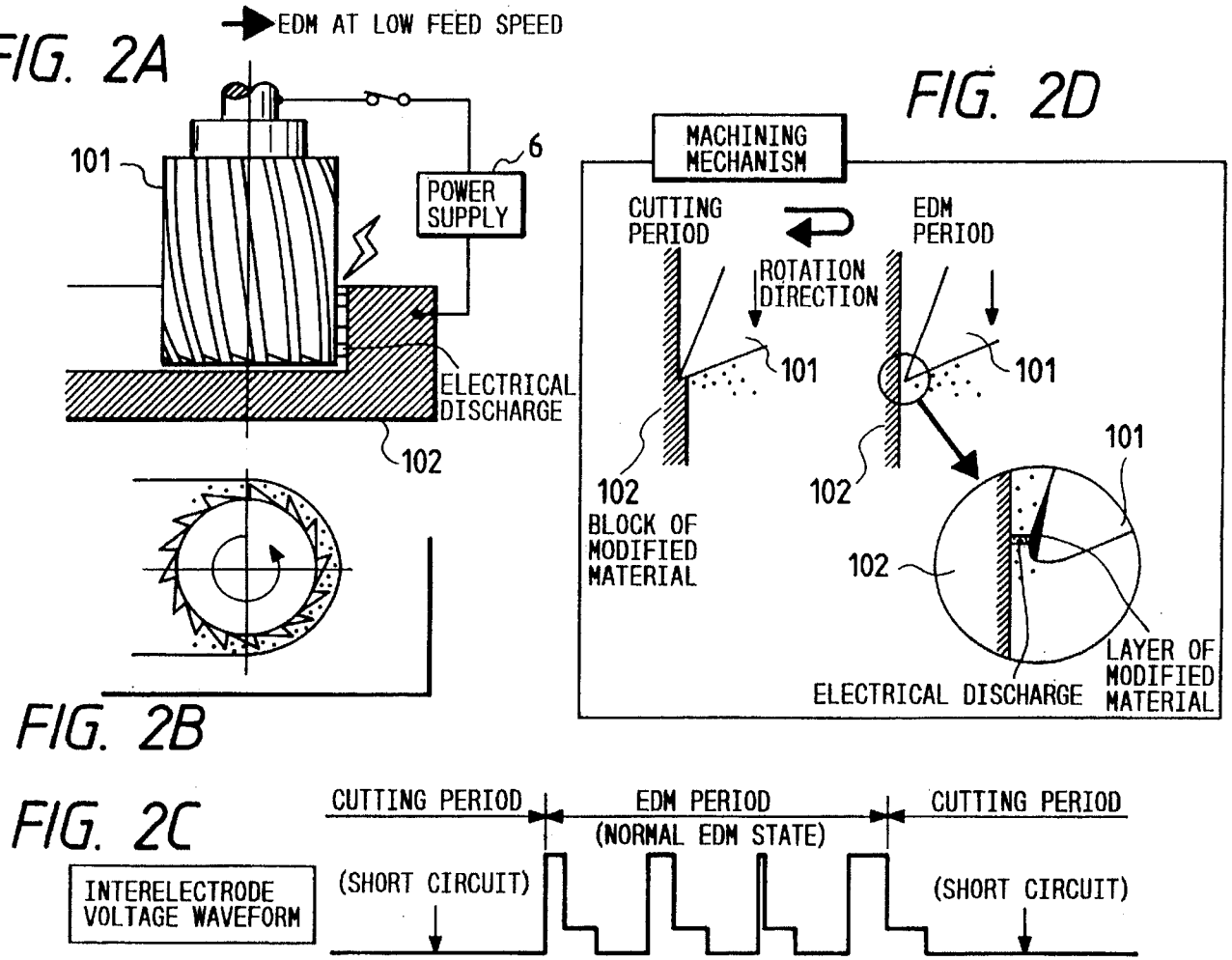
FIGS. 2A and 2B illustrate a view of the tool during an EDM process at low speed.
FIG. 2C illustrates a waveform for alternating cutting and EDM operation.
FIG. 2D illustrates the machining mechanism at the cutting edge tip during the cutting and EDM periods.

An operation will now be described. The rotary cutting tool 101 held by the chucking device 8 is rotated by the rotating device 9, and the rotary cutting tool 101 and the powder compact block 102 are moved relative to each other by the X, Y and Z drives 11, 12, 13 to cut the powder compact block 102. Specifically, when the rotary cutting tool 101 is an end mill, cutting is carried out in side directions (X, Y directions), and when the rotary cutting tool 101 is a drill, cutting is performed in an axis direction (Z-axis direction). At this time, because of the electrical discharge machining voltage applied between the rotary cutting tool 101 and the powder compact block 102 by the electrical discharge machining power supply 6, electrical discharge takes place in the machining gap when the rotary cutting tool 101 and the powder compact block 102 in contact with each other are separated in the process of cutting. Since the modifying material (W-C) strays into the machining gap in the form of powder as a result of cutting, electrical discharge causes the W-C powder in the dielectric to enter the cutting edge surface of the rotary cutting tool 101. By controlling the feed rate of the rotary cutting tool 101 properly as described above, machining is conducted consecutively with cutting and electrical discharge alternated to form an even modification layer, i.e., W-C alloy layer, on the cutting edges. FIG. 2A and 2B represent side and top views showing the machining mechanism of the present invention and FIG. 2C shows the waveform of an interelectrode gap voltage. As shown in the waveform diagram, a cutting period and a discharge period are repeated with several to several tens ms frequency. More specifically, a short-circuit state is maintained during the cutting period whereas an electric discharge is continuously generated during the discharge period. The discharge and cutting machining, as illustrated in FIG. 2D, is carried out by repeating the cutting period and the EDM period so that an effective cutting of the workpiece 102 by edge 101, as well as an effective protection of edge 101 is accomplished.

To maintain the above-mentioned continuous process of cutting and electrical discharge, the control of the relative travel speed (feed rate) of the rotary cutting tool 101 is important. Namely, while control is exercised to back up an electrode moving track at the occurrence of a short circuit or the like (short circuit backup) in ordinary electrical discharge machining, the short circuit backup need not be conducted frequently in the present machining because the short circuit is overcome by cutting. Conversely, since the machining is conducted mainly by electrical discharge if the electrode retracting operation is performed too often, the concentration of the modifying material powder in the machining gap is reduced by cutting, decreasing a surface modification effect. Namely, in the present machining process, it is preferable to control the electrode retraction ratio and electrode feed rate so that cutting and electrical discharge machining are conducted at a proper ratio. For this purpose, the machining gap detector 14 in FIG. 1 detects the machining gap voltage in the machining gap and uses its average voltage to detect electrical discharge frequency, i.e., an amount equivalent to an electrical discharge machining amount, in the machining gap. Using this result and the current tool feed rate, the control device 15 finds the ratio of electrical discharge machining to cutting and changes and controls the tool feed rate to maintain said ratio at a proper value. Also, by changing the tool feed rate and changing the ratio of cutting to electrical discharge machining, the thickness of the modification layer can be changed. In other words, high feed rate in the initial stage of treatment allows a thick modification layer to be formed and low feed rate in final finishing allows the finished modification layer to be even an.

Figures 3A, 3B, 3C:
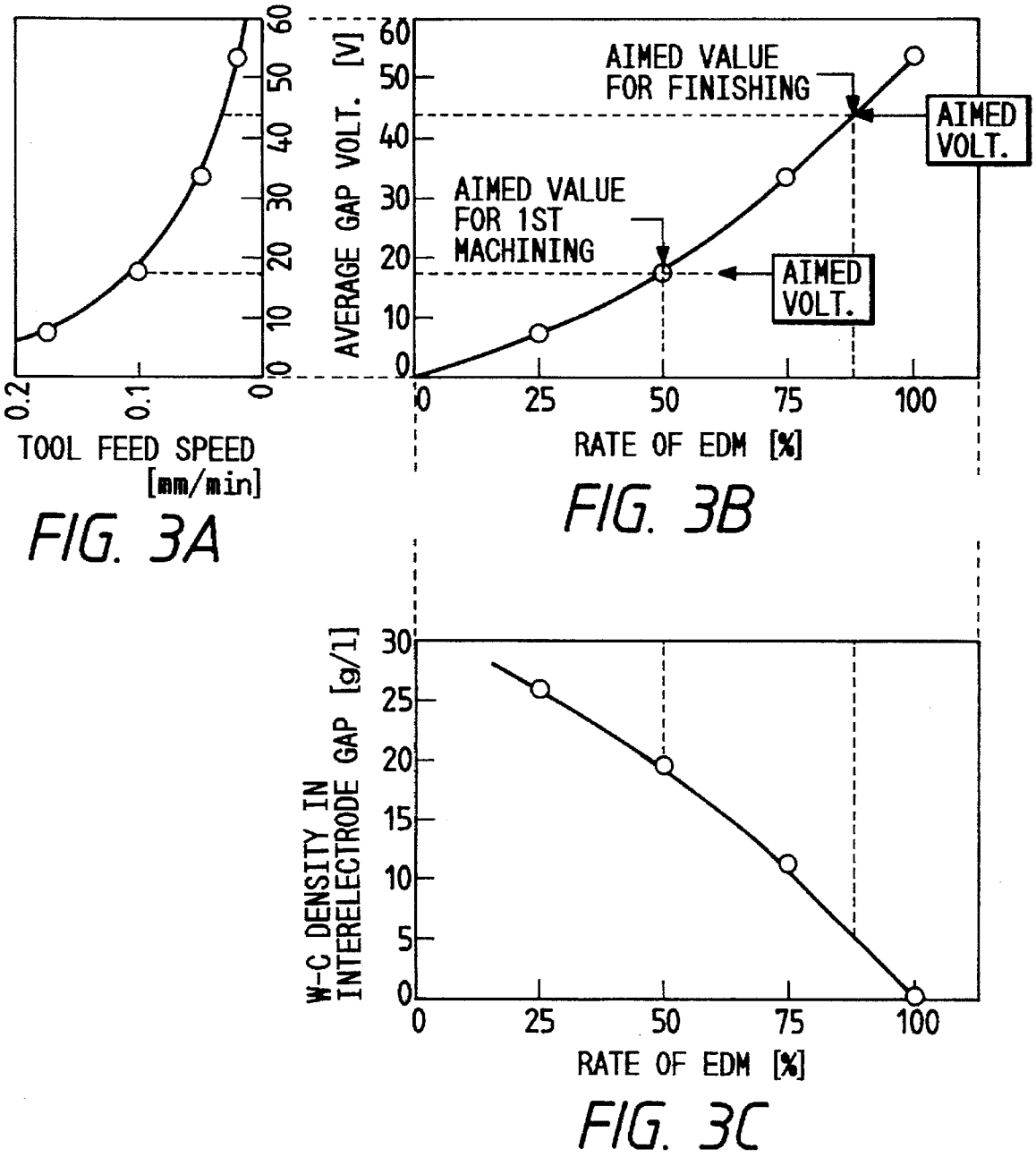
FIGS. 3A–3C illustrate the related relationships among tool feed speed, EDM rate and voltage in connection with the first embodiment.

FIGS. 3A–3C are interrelated diagrams showing the result of a control of discharge and cutting machining in accordance with the present invention. Upon preliminary treating, a control voltage is set to 18 V and a tool feed speed is set to 0.1 mm/min., so that the rate of electric discharge is made 50% (the rate of cutting being set to 50%). In this state, powder density in the interelectrode is about 20 g/l, as a result of which a thick W-C layer is formed on the surface of tool. Thereafter, upon finishing treatment, the control voltage is set to 44 V and the tool feed speed is set to 0.03 mm/min. so that the rate of electric discharge is made 90% (the rate of cutting being set to 10%). In this state, the powder density is reduced to about 5 g/l, so that the thick W-C layer is subjected to a re-melting treatment to produce a fine improved surface thereon.

The stability of electrical discharge is also influenced by the rotary speed of the rotary cutting tool. Namely, too high rotary speed causes an electrical discharge point during the period of a single discharge pulse in the machining gap to move, making it difficult to maintain a discharge arc and reducing electrical discharge efficiency, i.e., as the rotary speed is higher, the cutting efficiency increases whereas the electrical discharge efficiency decreases and the cutting ratio increases. By contrast, as the rotary speed is lower, the cutting efficiency lowers and the electrical discharge efficiency rises. Hence, the ratio of electrical discharge machining to cutting can also be changed by the rotary speed. Since the surface speed depends on the tool diameter even at the same rotary speed, it is preferable to exercise control to provide proper rotary speed according to the tool diameter.

Figure 4A:
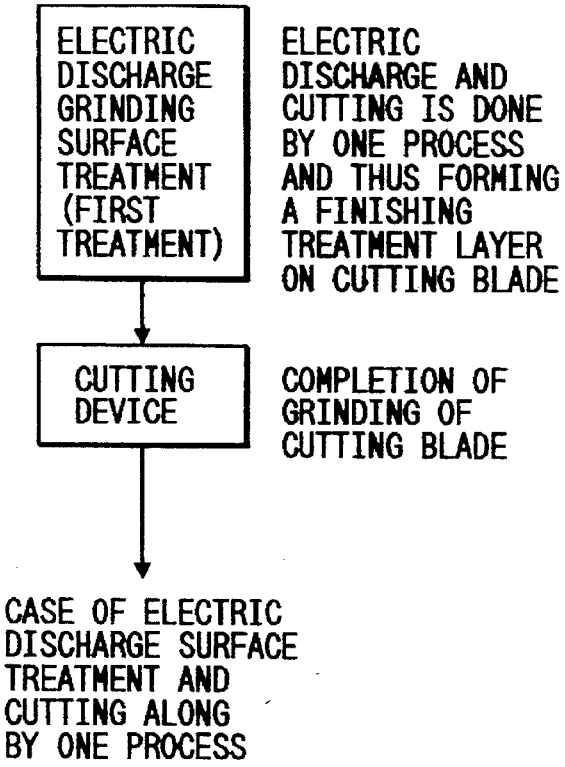
FIGS. 4A and 4B show alternate processes for modifying a tool edge and FIG. 4C shows the effect of such processes on a tool blade.
Figure 4B:
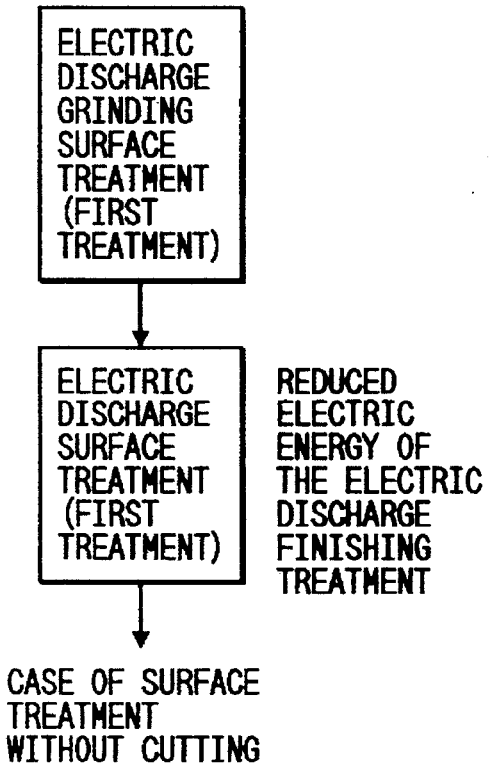
Figure 4C:
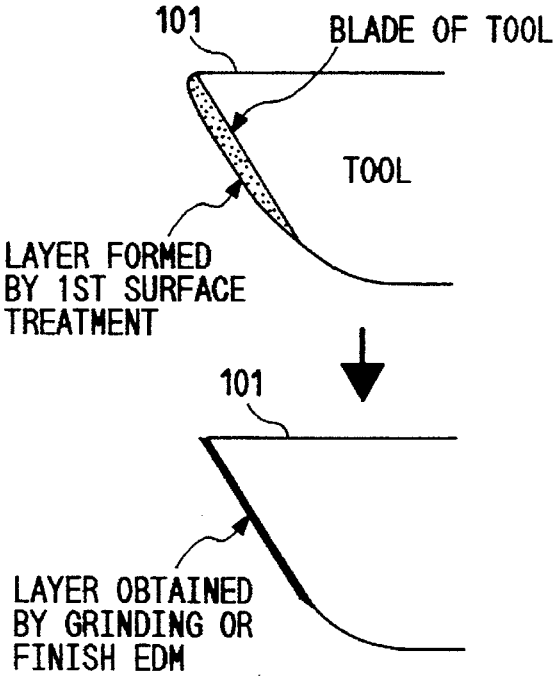

FIGS. 4A and 4B are diagrams showing the steps of electric discharge surface treatment according to the present invention. The treatment is accomplished, as shown in FIG. 4A by carrying out the combination of electric discharge surface treatment and grinding a tool. Alternatively, the treatment is accomplished, as shown in FIG. 4B by carrying out the electric discharge surface treatment only, without the grinding. In the case of the process of FIG. 4A, after the surface treatment is accomplished, the tool is attached to a tool grinding device to grind a cutting blade of the tool. On the other hand, in the case of the process seen in FIG. 4B, the finishing is carried out by the electric discharge instead of the tool grinding. The finishing is accomplished instead of the grinding of cutting blade by reducing the electric energy of the electric discharge finishing treatment so as to complete the fine surface thereof. The result of the two processes is illustrated in FIG. 4C.

After the modification layer has been formed on the cutting edges in either process, the electric discharge power source 6 is controlled to stop the application of the inter-electrode voltage. Thereafter, only cutting is conducted for a while, whereby the cutting edges where the modification layer has been formed are ground to provide extremely excellent cutting edges from where discharge spots on the surface have been removed. At this time, it is recommended to also use reverse operation in the tool rotating direction, relative movement in the tool axis direction, or the like.

It will be appreciated that machining may be conducted while the tool is dipped in a machining bath 4 filled with dielectric or machining may be carried out while the tool is being sprayed by, for example, a non-combustible fluid used as the dielectric.

Figure 5:
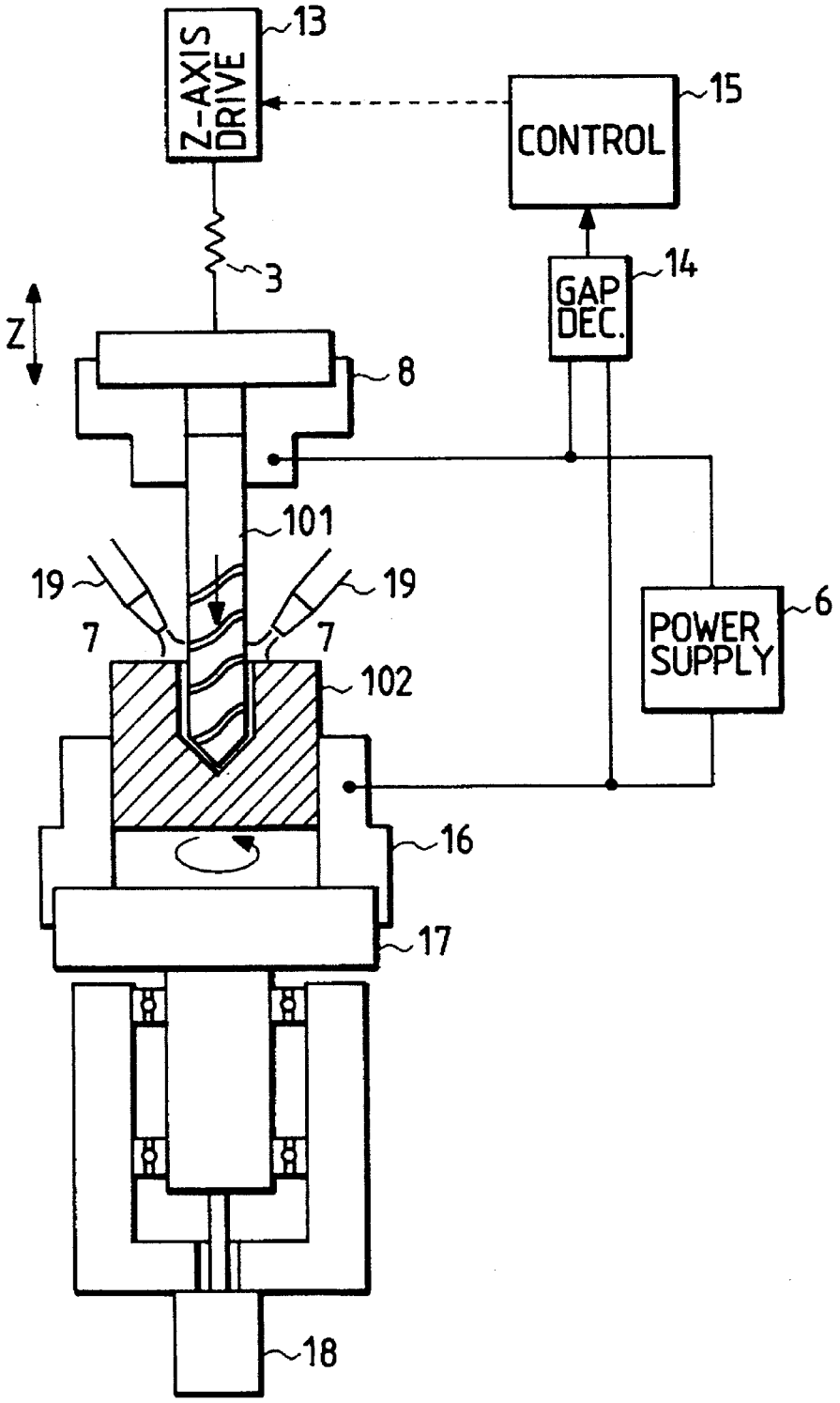
FIG. 5 is a diagram showing machining in a second embodiment of the present invention.

The second embodiment of the present invention will now be described in accordance with FIG. 5, wherein 101 indicates a rotary cutting tool, such as a drill, to be surface treated and 102 designates a powder compact block which has been made by molding the powder of a modifying material, i.e., which has been made by sinter molding the powder of W-C (tungsten carbide) mixed with Co (cobalt) as the modifying material. 3 denotes a spindle which moves the rotary cutting tool 101 in the vertical direction (Z-axis direction), 8 designates a chucking device which holds the rotary cutting tool 101, 16 represents a chucking device which holds the powder compact block 102, 17 indicates a rotating device which rotates the powder compact block 102, 18 designates a rotating motor which rotates the rotating device 17, 13 denotes a Z-axis drive which drives the spindle 3 together with the rotary cutting tool 101 in the Z direction (vertical direction), 6 represents an electrical discharge machining power supply which applies a voltage between the rotary cutting tool 101 and the powder compact block 102, 7 indicates a dielectric, 19 denotes dielectric supply nozzles which supply the machining gap with the dielectric, 14 represents a machining gap detector which detects a machining gap voltage or a short circuit between the rotary cutting tool 101 and the powder compact block 102, and 15 designates a control device which controls the relative travel speeds of the rotary cutting tool 101 and the powder compact block 102 according to the detection result of the machining gap detector 14.

Operation will now be described. The powder compact block 102 held by the chucking device 16 is rotated by the rotating device 17, and the rotary cutting tool 101 and the powder compact block 102 are moved relative to each other by the Z-axis drive 13 to cut the powder compact block 102. At this time, because of the electrical discharge machining voltage applied between the rotary cutting tool 101 and the powder compact block 102 by the electrical discharge machining power supply 6, electrical discharge occurs in the machining gap when the rotary cutting tool 101 and the powder compact block 102 in contact with each other are separated in the process of cutting. Since the modifying material (W-C) strays into the machining gap in the form of a powder as a result of cutting, electrical discharge causes the W-C powder in the dielectric to enter the cutting edge surface of the rotary cutting tool 101. By controlling the Z-axis feed rate of the rotary cutting tool 101 properly as described above, machining is conducted consecutively with cutting and electrical discharge alternated to form an even modification layer, i.e., W-C alloy layer, on the cutting edges.

The machining gap detector 14 detects the machining gap voltage in the machining gap and uses its average voltage to detect electrical discharge frequency, i.e., an amount equivalent to an electrical discharge machining amount, in the machining gap. Using this result and the current tool feed rate, the control device 15 obtains the ratio of electrical discharge machining to cutting and changes and controls the tool feed rate to maintain the ratio at a proper value. Also, by changing the tool feed rate and changing the ratio of cutting to electrical discharge machining, the thickness of the modification layer can be changed. In other words, high feed rate in the initial stage of treatment allows a thick modification layer to be formed and low feed rate in final finishing allows the finished modification layer to be even and thin.

It is to be understood that the stability of electrical discharge is also influenced by the rotary speed of the rotating device 17. Namely, too high rotary speed causes an electrical discharge point during the period of a single discharge pulse in the machining gap to move, making it difficult to maintain a discharge arc and reducing electrical discharge efficiency, i.e., as the rotary speed is higher, the cutting efficiency increases, whereas the electrical discharge efficiency decreases and the cutting ratio increases. By contrast, as the rotary speed is lower, the cutting efficiency lowers and the electrical discharge efficiency rises. Hence, the ratio of electrical discharge machining to cutting can also be changed by the rotary speed. Since the surface speed depends on the tool diameter even at the same rotary speed, it is preferable to exercise control to provide proper rotary speed according to the tool diameter.

Figure 6:
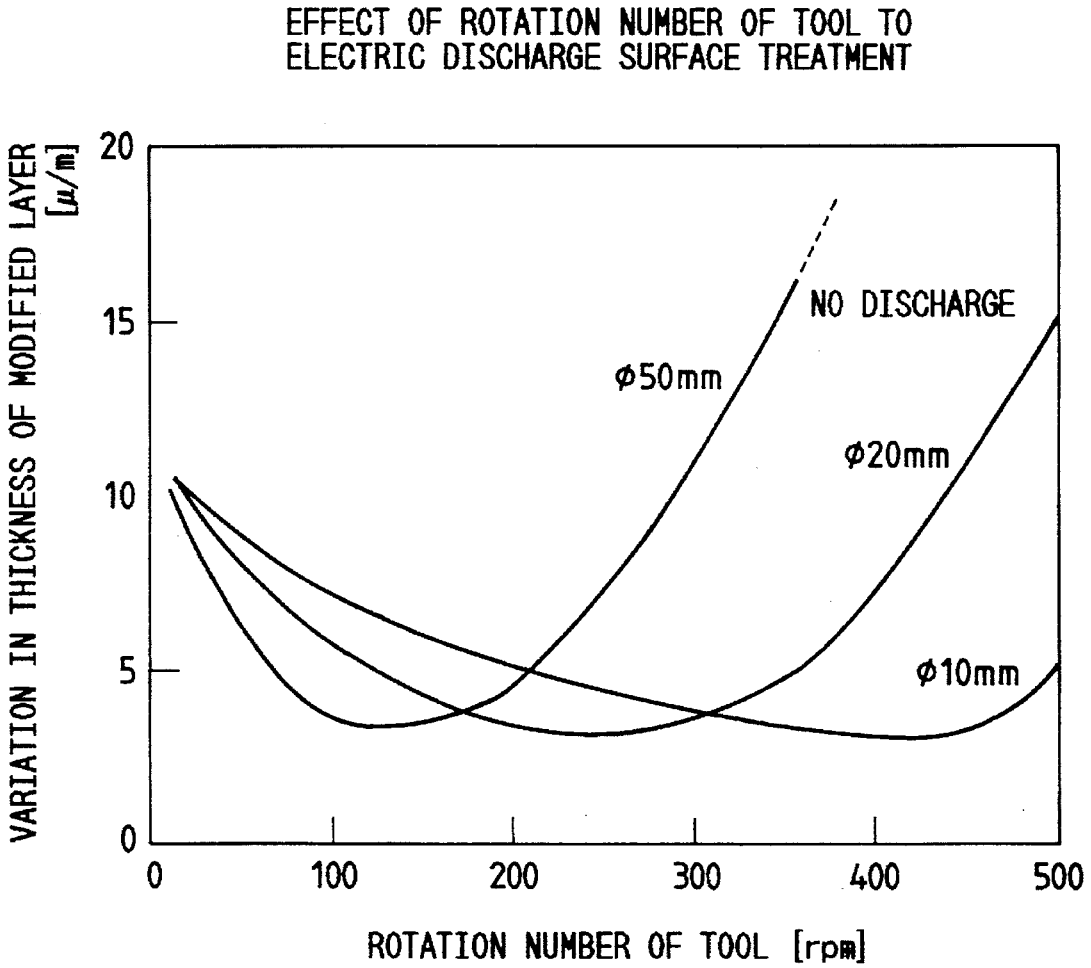
FIG. 6 is a graph illustrating the effect of tool rotation on the thickness of the modified layer.

FIG. 6 is a graphical representation showing the effect of the rotation of a tool on the electric discharge surface treatment. In FIG. 5, a vertical axis indicates variation in thickness of a modified layer whereas a horizontal axis indicates the number of rotation of tool.

After the modification layer has been formed on the cutting edges in said process, the application of the voltage by the electrical discharge machining power supply 6 is stopped and only cutting is carried out for a while, whereby the cutting edges where the modification layer has been formed are ground to provide extremely excellent cutting edges from where discharge spots on the surface have been removed. At this time, it is recommended to also use reverse operation in the rotating direction, relative movement in the tool axis direction.

Namely, while the tool to be modified was rotated in the first embodiment, the present embodiment differs from the first embodiment in that the powder compact block 102 is rotated. Particularly the surface modification of a tool which cuts in the axial direction, e.g., a drill, can be made in a simpler structure as in the present embodiment.

It will be recognized that the powder compact block 102 employed to modify the rotary cutting tool 101 in the first and second embodiments may be substituted by a block molded by using a temporarily sintered material or a mud material (mud dissolved by water and dried like plaster) if it cuts easily.

Figure 7:
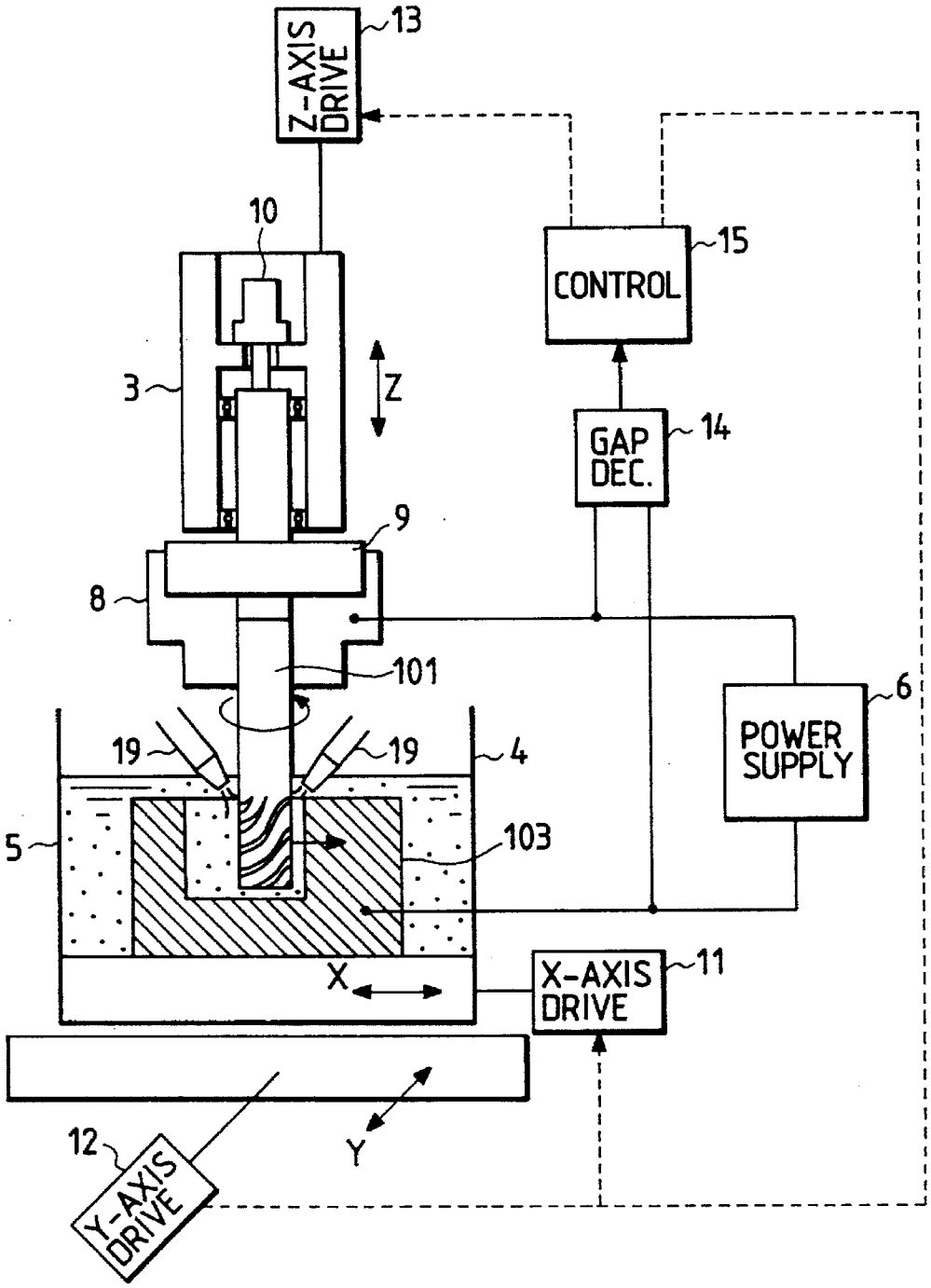
FIG. 7 is a diagram illustrating a fourth embodiment of the present invention.

A fourth embodiment of the present invention will now be described in accordance with FIG. 7, wherein 101 indicates a rotary cutting tool (end mill) to be surface treated, 103 designates a metallic material block (Cu), 3 denotes a spindle which moves the rotary cutting tool 101 in the vertical direction (Z-axis direction), 4 represents a machining bath in which the metallic material block 103 is secured and which is filled with an electrical discharge machining dielectric, 5 indicates a dielectric including W-C powder as a modifying material, 6 denotes an electrical discharge machining power supply which applies a voltage between the rotary cutting tool 101 and the metallic material block 103, 8 represents a chucking device which holds the rotary cutting tool 101, 9 designates a rotating device which rotates the rotary cutting tool, 10 indicates an electrode rotating motor which rotates the rotating device 9, 11 denotes an X-axis drive which drives the machining bath 4 together with the metallic material block 103 in the X direction, 12 indicates a Y-axis drive which drives the same in the Y direction, 13 denotes a Z-axis drive which drives the spindle 3 together with the rotary cutting tool 101 in the Z direction (vertical direction), 14 represents a machining gap detector which detects a machining gap voltage or a short circuit between the rotary cutting tool 101 and the metallic material block 103, 15 designates a control device which controls the relative travel speeds of the rotary cutting tool 101 and the metallic material block 103 according to the detection result of the machining gap detector 14, and 19 indicates dielectric supply nozzles which supply the machining gap with the dielectric 5 including modifying material powder.

Operation will now be described. As in the first embodiment, the rotary cutting tool 101 held by the chucking device 8 is rotated by the rotating device 9, and the rotary cutting tool 101 and the metallic material block 103 are moved relative to each other by the X, Y and Z drives 11, 12, 13 to cut the metallic material block 103. At this time, the machining gap formed by the rotary cutting tool 101 and the metallic material block 103 is supplied by the dielectric supply nozzles 19 with the dielectric 5 which includes the modifying material powder. Also because of the electrical discharge machining voltage applied between the rotary cutting tool 101 and the metallic material block 103 by the electrical discharge machining power supply 6, electrical discharge takes place in the machining gap when the rotary cutting tool 101 and the metallic material block 103 in contact with each other are separated in the process of cutting. Since the modifying material powder (W-C) that has entered the dielectric strays in the machining gap, electrical discharge causes the W-C powder in the dielectric to enter the cutting edge surface of the rotary cutting tool 101. By controlling the feed rate of the rotary cutting tool 101 properly as described above, machining is conducted consecutively with cutting and electrical discharge alternated to form an even modification layer, i.e., W-C alloy layer, on the cutting edges.

To maintain the above-mentioned continuous process of cutting and electrical discharge, the control of the relative travel speed (feed rate) of the rotary cutting tool 101 is also important in the present embodiment as in the first embodiment. Namely, it is also preferable to control the electrode retraction ratio and electrode feed rate in the present machining process so that cutting and electrical discharge machining are conducted at a proper ratio. For this purpose, as in the first embodiment, the machining gap detector 14 detects the machining gap voltage in the machining gap and uses its average voltage to detect electrical discharge frequency, i.e., an amount equivalent to an electrical discharge machining amount, in the machining gap. Using this result and the current tool feed rate, the control device 15 finds the ratio of electrical discharge machining to cutting and changes and controls the tool feed rate to maintain that ratio at a proper value. Also, by changing the tool feed rate and changing the ratio of cutting to electrical discharge machining, the thickness of the modification layer San be changed. In other words, high feed rate in the initial stage of treatment allows a thick modification layer to be formed and low feed rate in final finishing allows the finished modification layer to be even and thin.

It is to be understood that the stability of electrical discharge is also influenced by the rotary speed of the rotary cutting tool. Namely, too high rotary speed causes an electrical discharge point during the period of a single discharge pulse in the machining gap to move, making it difficult to maintain a discharge arc and reducing electrical discharge efficiency, i.e., as the rotary speed is higher, the cutting efficiency increases, whereas the electrical discharge efficiency decreases and the cutting ratio increases. By contrast, as the rotary speed is lower, the cutting efficiency lowers and the electrical discharge efficiency rises. Hence, the ratio of electrical discharge machining to cutting can also be changed by the rotary speed. Since the surface speed depends on the tool diameter even at the same rotary speed, it is preferable to exercise control to provide proper rotary speed according to the tool diameter.

Figures 8A, 8B:
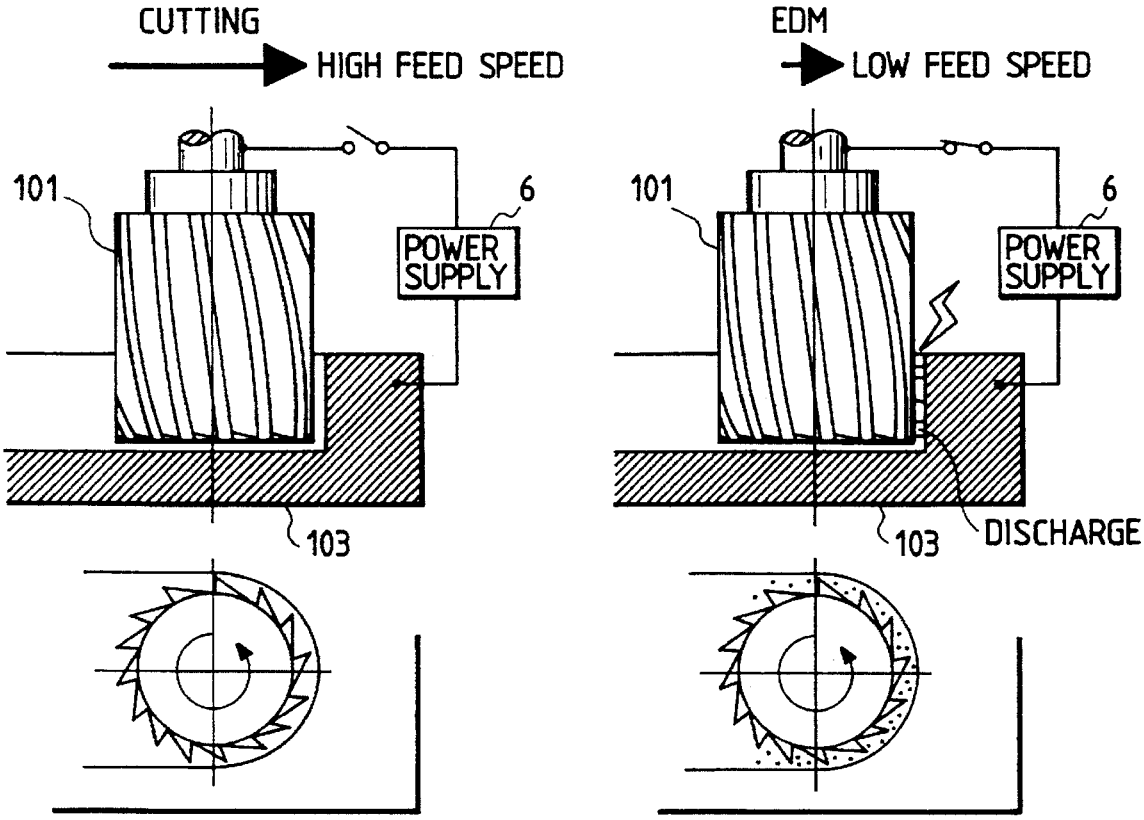
FIGS. 8A and 8B illustrate the use of high feed speed cutting and low feed speed EDM.

While, as is similar to the first embodiment, the electric discharge machining and the cutting machining are repeatedly carried out to accomplish the electric discharge surface treatment in the above mentioned embodiment, in case of mixing a modification agent powder into a machining solution, the above two operation may be carried out separately as shown in FIGS. 8A and 8B, and FIGS. 9A and 9B. More specifically, FIGS. 8A and 8B show the case where the electric discharge machining is carried out after cutting machining with the mixture of machining solution and powders. In FIG. 8A, the power source 6 is turned off, and then the cutting machining is only carried out at a high tool feed speed in order to form a machining gap for electric discharge machining, which is shaped to the configuration of the tool. Subsequently, as seen in FIG. 8B, the power source 6 is turned on to carry out the electric discharge machining at a low tool feed speed. In this case, only electric discharge is carried out or the extremely low rate of cutting machining is carried out to subjecting the cutting blade of the tool 101 to the surface treatment.

Figures 9A, 9B:
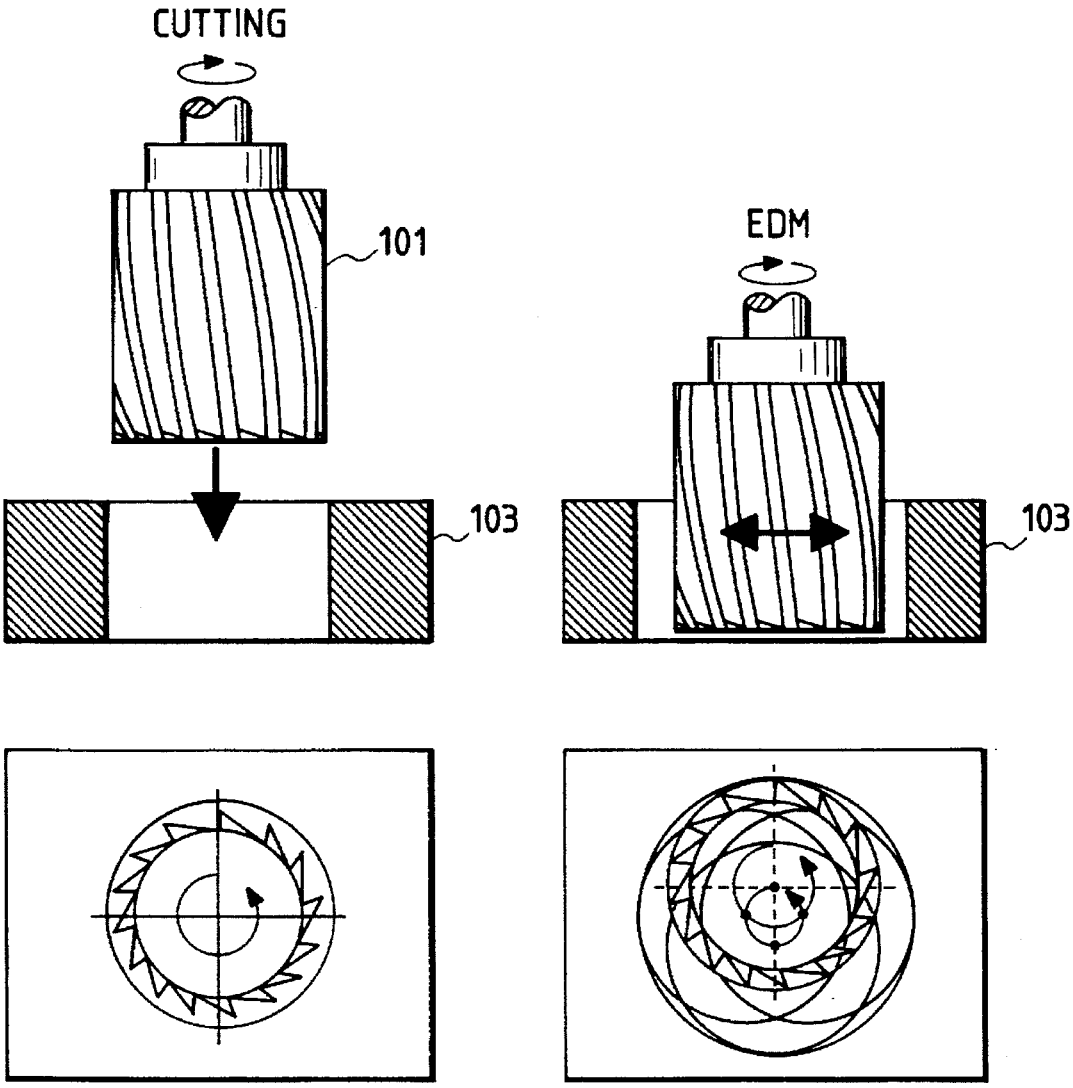
FIGS. 9A and 9B illustrate another embodiment where EDM and cutting alternate.

FIGS. 9A and 9B are diagrams showing the case where the electric discharge machining is carried out after cutting machining with the mixture of machining solution and powders. A metal block 103 which has been drilled as shown in FIG. 9A, is used as a workpiece to be machined, and the cutting machining is performed on the metal block 103 to form an electric discharge machining gap. Then, as seen in FIG. 9B, the tool electrode 101 may be rotated mutually with regard to the metal block 103 during the electric discharge surface treatment. The embodiment shown in FIGS. 9A and 9B is advantageous in that the workpiece can be used effectively.

The treatment methods as shown in FIGS. 8A and 8B, and 9A and 9B may be applicable to the first and second embodiments of the present invention. That is, the embodiments may be modified in such a manner that the cutting machining may be only carried out to form the machining gap and then both electric discharge and cutting machinings are carried out to perform desired surface treatment.

Figures 10A, 10B:
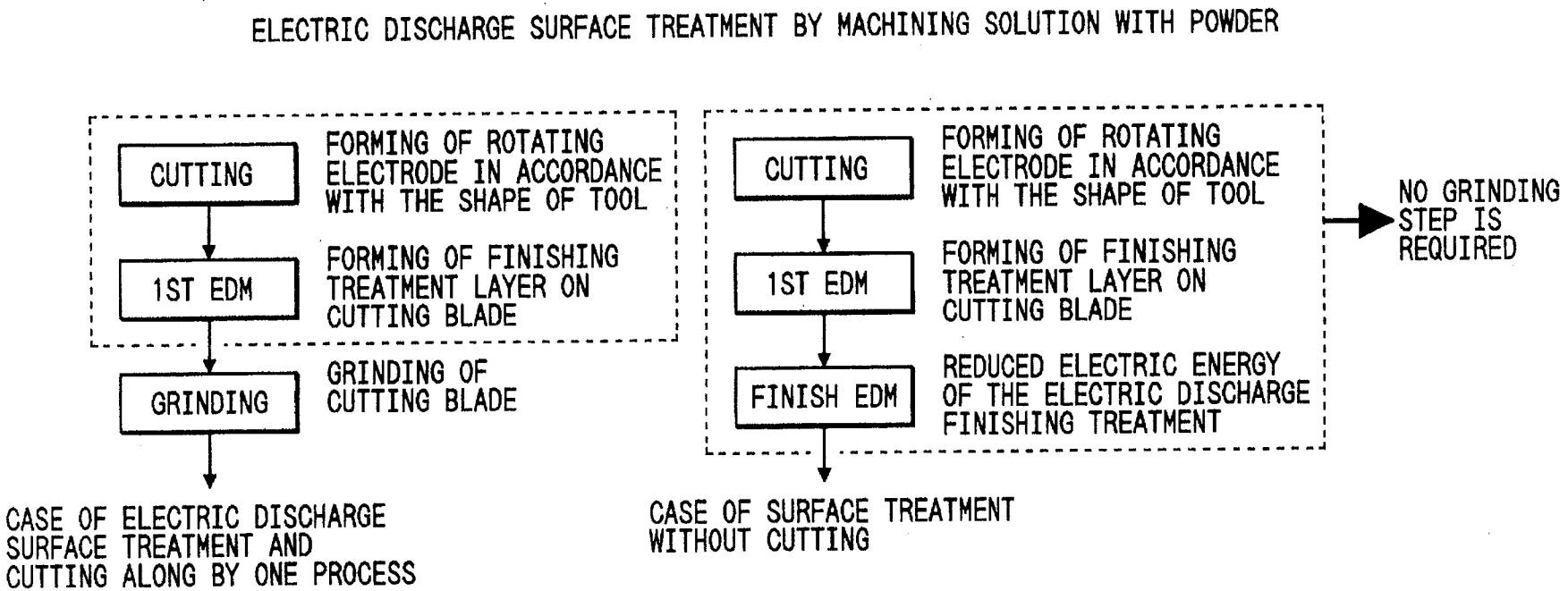
FIGS. 10A and 10B illustrate alternative processes for performing the cutting and EDM processes to a finishing step.

FIGS. 10A and 10B are diagrams showing the steps for an electric discharge surface treatment. There are two types and in FIG. 10A, there is a combination of electric discharge surface treatment and grinding the blade of tool. In FIG. 10B, there is only a surface treatment. In case of FIG. 10A, after the surface treatment as described above, the tool is attached to a grinding device so as to accomplish the grinding and polishing of the blade of the tool. In the process of FIG. 10B, electric discharge finishing also acts as the grinding mechanism. In the process of FIG. 10B, the electric discharge energy for the finishing is reduced to carry out the fine surface finishing treatment to thereby remove the step of grinding the blade of tool.

After the modification layer has been formed on the cutting edges in this process, the application of the voltage by the electrical discharge machining power supply 6 is stopped and only cutting is performed for a while, whereby the cutting edges where the modification layer has been formed are ground to provide extremely excellent cutting edges from where discharge spots on the surface have been removed. At this time, it is recommended to also use reverse operation in the tool rotating direction, relative movement in the tool axis direction, or the like.

Unlike the first embodiment, the modifying material powder is already included in the dielectric in the present embodiment. Hence, cutting is conducted to merely cause the tool to trace the shape of the metallic material block 103 to form a given discharge gap between the metallic material block 103 and the cutting edges of the rotary cutting tool 101. Therefore, since the cutting speed (cut amount) does not influence the modifying material powder concentration in the machining gap, the cutting ratio can be reduced considerably to carry out treatment of high discharge ratio as compared to the first embodiment.

Figure 11:
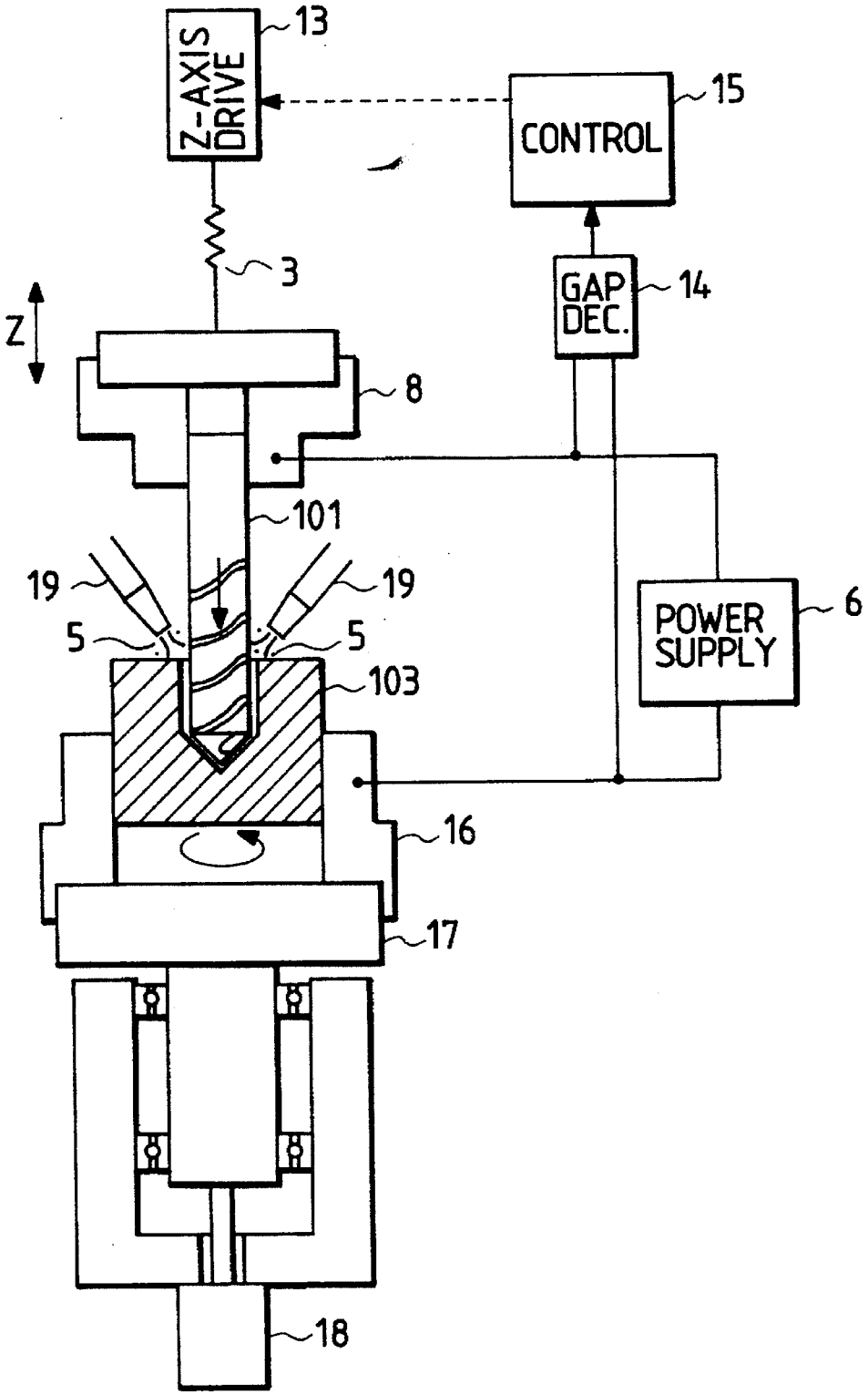
FIG. 11 is a diagram showing a fifth embodiment of the present invention.
Figure 12:
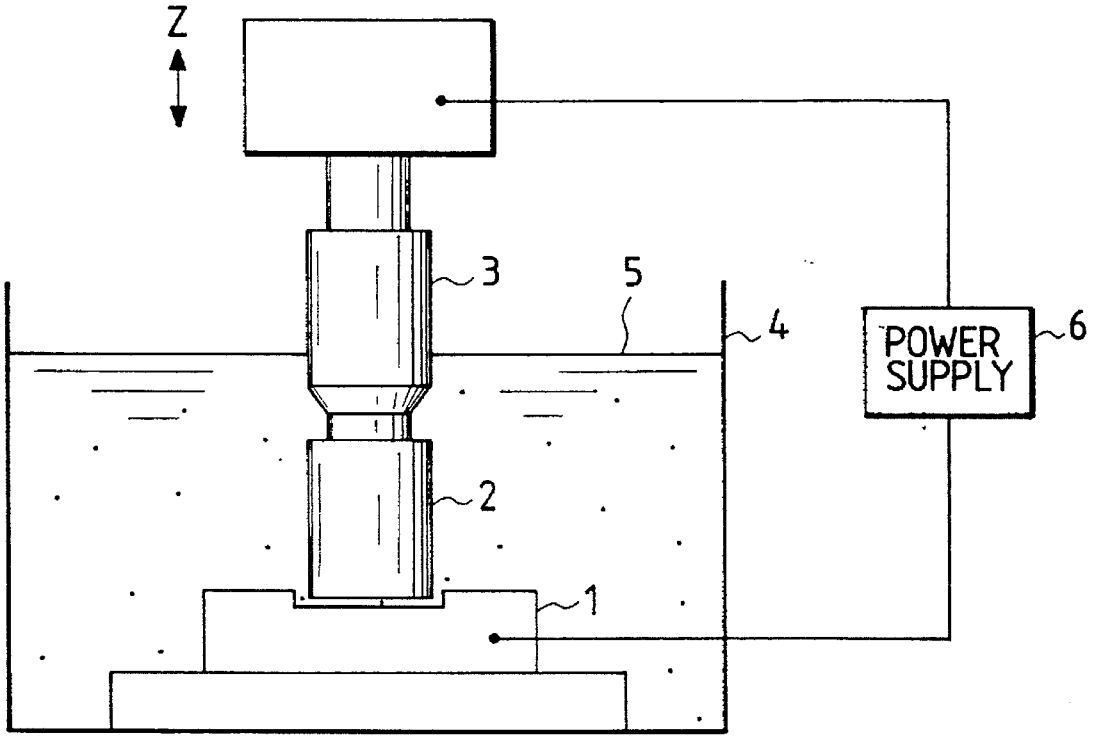
FIG. 12 PRIOR ART
FIG. 12 is a diagram showing a conventional surface treatment apparatus by electrical discharge machining.

A fifth embodiment of the present invention will now be described in accordance with FIG. 11, wherein 101 indicates a rotary cutting tool (drill) to be surface treated, 103 designates a metallic material block (Cu), 3 denotes a spindle which moves the rotary cutting tool 101 in the vertical direction (Z-axis direction), 8 designates a chucking device which holds the rotary cutting tool 101, 16 represents a chucking device which holds the metallic material block 103, 17 indicates a rotating device which rotates the metallic material block 103, 18 designates a rotating motor which rotates the rotating device 17, 13 denotes a Z-axis drive which drives the spindle 3 together with the rotary cutting tool 101 in the Z direction (vertical direction), 5 indicates a dielectric including W-C powder as a modifying material, 19 denotes dielectric supply nozzles which supply the machining gap with the dielectric, 6 represents an electrical discharge machining power supply which applies a voltage between the rotary cutting tool 101 and the metallic material block 103, 14 represents a machining gap detector which detects a machining gap voltage or a short circuit between the rotary cutting tool 101 and the metallic material block 103, and 15 designates a control device which controls the relative travel speeds of the rotary cutting tool 101 and the metallic material block 103 according to the detection result of the machining gap detector 14.

Operation will now be described. The metallic material block 103 held by the chucking device 16 is rotated by the rotating device 17, and the rotary cutting tool 101 and the metallic material block 103 are moved relative to each other by the Z-axis drive 13 to cut the metallic powder block 103. At this time, the machining gap formed by the rotary cutting tool 101 and the metallic material block 103 is supplied by the dielectric supply nozzles 19 with the dielectric 5 which includes the modifying material powder. Also because of the electrical discharge machining voltage applied between the rotary cutting tool 101 and the metallic material block 103 by the electrical discharge machining power supply 6, electrical discharge takes place in the machining gap when the rotary cutting tool 101 and the metallic material block 103 in contact with each other are separated in the process of cutting. Since the modifying material powder (W-C) strays in the machining gap in the form of powder as a result of cutting, electrical discharge causes the W-C powder in the dielectric to enter the cutting edge surface of the rotary cutting tool 101. By controlling the Z-axis feed rate of the rotary cutting tool 101 properly as described above, machining is conducted consecutively with cutting and electrical discharge alternated to form an even modification layer, i.e., W-C alloy layer, on the cutting edges.

The machining gap detector 14 detects the machining gap voltage in the machining gap and uses its average voltage to detect electrical discharge frequency, i.e., an amount equivalent to an electrical discharge machining amount, in the machining gap. Using this result and the current tool feed rate, the control device 15 obtains the ratio of electrical discharge machining to cutting and changes and controls the tool feed rate to maintain said ratio at a proper value. Also, by changing the tool feed rate and changing the ratio of cutting to electrical discharge machining, the thickness of the modification layer can be changed. In other words, high feed rate in the initial stage of treatment allows a thick modification layer to be formed and low feed rate in final finishing allows the finished modification layer to be made even and thin.

It is to be understood that the stability of electrical discharge is also influenced by the rotary speed of the rotating device 17. Namely, too high rotary speed causes an electrical discharge point during the period of a single discharge pulse in the machining gap to move, making it difficult to maintain a discharge arc and reducing electrical discharge efficiency, i.e., as the rotary speed is higher, the cutting efficiency increases, whereas the electrical discharge efficiency decreases and the cutting ratio increases. By contrast, as the rotary speed is lower, the cutting efficiency lowers and the electrical discharge efficiency rises. Hence, the ratio of electrical discharge machining to cutting can also be changed by the rotary speed. Since the surface speed depends on the tool diameter even at the same rotary speed, it is preferable to exercise control to provide proper rotary speed according to the tool diameter.

After the modification layer has been formed on the cutting edges in said process, the application of the voltage by the electrical discharge machining power supply 6 is stopped and only cutting is conducted for a while, whereby the cutting edges where the modification layer has been formed are ground to provide extremely excellent cutting edges from where discharge spots on the surface have been removed. At this time, it is recommended to also use reverse operation in the rotating direction, relative movement in the tool axis direction, or the like.

Specifically, while the tool to be modified was rotated in the fourth embodiment, the present embodiment differs from the fourth embodiment in that the metallic material block 103 is rotated. Particularly the surface modification of a tool which cuts in the axial direction, e.g., a drill, can be made in a simpler structure as in the present embodiment.

Since the dielectric already includes the modifying material powder in the present embodiment unlike the second embodiment, cutting is conducted to merely cause the tool to trace the shape of the metallic material block 103 to form a given discharge gap between the metallic material block 103 and the cutting edges of the rotary cutting tool 101. Hence, the cutting speed (cut amount) does not influence the modifying material powder concentration in the machining gap, whereby the cutting ratio can be reduced considerably to carry out treatment of high discharge ratio as compared to the second embodiment.

In any of these above-described embodiments, the chucking device 8 may be designed to hold any of rotary cutting tools different in shank diameter to accept a wide variety of tools. Other clamp mechanisms, such as taper shanks, may be used and tools changed automatically to make continuous surface modification of a multiplicity of tools, whereby a large number of tools can be surface treated with higher productivity.

W-C employed as the example of the modifying material in any of the above embodiments may be replaced by ceramic-based material powder, e.g., Ti-C (titanium carbide) or Ti-N (titanium nitride), which includes conductive powder such as Ni (nickel).

While surface treatment was carried out on the rotary cutting tool in any of the above embodiments, a rotary electrical discharge machining electrode and an axially symmetrical tool may also be surface treated identically in any of said embodiments. In such cases, they are surface treated by only electrical discharge machining and are not cut.

Also, in any of the described embodiments, when the block including the modifying material is rotated, an existing machine such as a lathe may be used to carry out electrical discharge surface treatment more easily.

It will be apparent that the present invention, as described above, achieves a surface treatment method which comprises rotating a modified metallic member to be surface modified or a block including a modifying material and generating electrical discharge between the block including the modifying material and said modified metallic member to form a modification layer on the surface of said modified metallic member, whereby surface modification can be made easily on the surface of a rotary electrical discharge machining electrode or an axially symmetrical part to provide a rotary electrical discharge machining electrode extremely low in consumption and an axially symmetrical part excellent in wear resistance and corrosion resistance.

It will also be apparent that the present invention achieves an electrical discharge surface treatment method to form a modification .layer on a metal surface by electrical discharge machining, which comprises rotating a rotary cutting tool or a block including a modifying material and relatively moving the block including the modifying material and the rotary cutting tool to cut said block including the modifying material by means of said rotary cutting tool, and generating electrical discharge between the cutting edges of said cutting tool and said block including the modifying material to form a modification layer on the cutting edges of said rotary cutting tool, whereby the cutting edges of a cutting tool complicated in shape can be surface modified easily to carry out tool surface treatment which increases a cutting tool life greatly.

It will also be apparent that the present invention achieves a surface treatment method which comprises rotating a modified metallic member to be surface modified or a metallic material block, and supplying a dielectric including modifying material powder between said metallic material block and said modified metallic member and simultaneously generating electrical discharge between said modified metallic member and said metallic material block to form a modification layer on the surface of said modified metallic member, whereby surface modification can be made easily on the surface of a rotary electrical discharge machining electrode or an axially symmetrical part to provide a rotary electrical discharge machining electrode extremely low in consumption and an axially symmetrical part excellent in wear resistance and corrosion resistance. Also, the modifying material included in the dielectric beforehand enables the cut amount of the metallic material to be decreased, substantially reducing the amount of the metallic material electrically discharged with the tool. Further, a material excellent in electrical discharge machining performance, such as copper, can be used to stabilize electrical discharge machining and provide more uniform surface treatment. When the metallic material block is rotated, an existing machine such as a lathe may be used to carry out electrical discharge surface treatment more easily.

It will also be apparent that the present invention achieves a surface treatment method which comprises rotating a rotary cutting tool or a metallic material block and relatively moving the metallic material block and the rotary cutting tool to cut said metallic material block by means of said rotary cutting tool, and supplying a dielectric including modifying material powder and simultaneously generating electrical discharge between the cutting edges of said rotary cutting tool and said metallic material block to form a modification layer on the cutting edges of said rotary cutting tool, whereby the cutting edges of a cutting tool complicated in shape can be surface modified easily to carry out tool surface treatment which increases a cutting tool life greatly. Also, the modifying material included in the dielectric beforehand enables the cut amount of the metallic material to be decreased, substantially reducing the amount of the metallic material electrically discharged with the tool. Further, a material excellent in electrical discharge machining performance, such as copper, can be used to stabilize electrical discharge machining and provide more uniform surface treatment.

It will also be apparent that the present invention achieves a surface treatment method which employs a ceramic-based material as said modifying material, whereby the wear resistance and corrosion resistance of the tool modification layer are improved remarkably. Also, by forming a high resistance film on an electrical discharge machining electrode surface by the surface treatment of said ceramic-based material, current components due to a machining gap capacitance can be reduced to improve an electrode consumption characteristic and surface roughness.

It will also be apparent that the present invention achieves a surface treatment method wherein cutting and electrical discharge machining are alternated to form the modification layer on the cutting edges of the rotary cutting tool and subsequently only cutting is carried out, without electrical discharge machining being conducted, to grind the cutting edges of the rotary cutting tool, whereby the cutting edges where the modification layer has been formed are ground to provide extremely excellent cutting edges from where electrical discharge spots on the surface have been removed.

It will also be apparent that the present invention achieves a surface treatment apparatus which comprises holding means for holding a rotary cutting tool or an electrical discharge machining electrode, a rotating device for rotating the rotary cutting tool or electrical discharge machining electrode held, fixing means for fixing a block including a modifying material opposite to said rotary cutting tool or electrical discharge machining electrode, a driving mechanism for relatively moving said rotary cutting tool or electrical discharge machining electrode and said block including the modifying material, and an electrical discharge machining power supply for applying a voltage between said rotary cutting tool or electrical discharge machining electrode and said block including the modifying material, and when the rotary cutting tool is rotated, which performs a rotary motion by means of said rotating device and relative movement by means of said driving mechanism to cut the block including the modifying material by means of said rotary cutting tool and generates electrical discharge between the cutting edges of said rotary cutting tool and said block including the modifying material to form the modification layer on the cutting edges of said rotary cutting tool, thereby providing an electrical discharge machining-basis surface treatment apparatus which can easily surface modify the cutting edges of a cutting tool complicated in shape, and as a result, carry out tool surface treatment to increase a cutting tool life greatly. Also, an electrical discharge machining electrode complicated in shape can be surface modified easily.

It will also be apparent that the present invention achieves a surface treatment apparatus which comprises holding means for holding a rotary cutting tool or an electrical discharge machining electrode, a rotating device for holding a block including a modifying material opposite to said rotary cutting tool or electrical discharge machining electrode and for rotating said block including the modifying material on the axis of said rotary cutting tool or electrical discharge machining electrode, a driving mechanism for relatively moving said rotary cutting tool or electrical discharge machining electrode and said block including the modifying material, and an electrical discharge machining power supply for applying a voltage between said rotary cutting tool or electrical discharge machining electrode and said block including the modifying material, and when the rotary cutting tool is rotated, which performs a rotary motion by means of said rotating device and relative movement by means of said driving mechanism to cut the block including the modifying material by means of said rotary cutting tool and generates electrical discharge between the cutting edges of said rotary cutting tool and said block including the modifying material to form the modification layer on the cutting edges of said rotary cutting tool, thereby providing an electrical discharge machining-basis surface treatment apparatus which can easily surface modify the cutting edges of a cutting tool complicated in shape, and as a result, carry out tool surface treatment to increase a cutting tool life greatly. Further, the modifying material is rotated as in a lathe, whereby an easier, lower-priced electrical discharge machining-basis surface treatment apparatus can be provided. Also, an electrical discharge machining electrode complicated in shape can be surface modified easily.

It will also be apparent that the present invention achieves a surface treatment apparatus which comprises holding means for holding a rotary cutting tool or an electrical discharge machining electrode, a rotating device for rotating the rotary cutting tool or electrical discharge machining electrode held, fixing means for fixing a metallic material block opposite to said rotary cutting tool or electrical discharge machining electrode, dielectric supplying devices for supplying a dielectric including modifying material powder between said rotary cutting tool or electrical discharge machining electrode and said metallic material block, a driving mechanism for relatively moving said rotary cutting tool or electrical discharge machining electrode and said metallic material block, and an electrical discharge machining power supply for applying a voltage between said rotary cutting tool or electrical discharge machining electrode and said metallic material block, and when the rotary cutting tool is rotated, which performs a rotary motion by means of said rotating device and relative movement by means of said driving mechanism to cut the metallic material block by means of said rotary cutting tool and supplies the dielectric including the modifying material and simultaneously generates electrical discharge between the cutting edges of said rotary cutting tool and said metallic material block to form the modification layer on the cutting edges of said rotary cutting tool, thereby providing an electrical discharge machining-basis surface treatment apparatus which can easily surface modify the cutting edges of a cutting tool complicated in shape, and as a result, carry out tool surface treatment to increase a cutting tool life greatly. Also, since the modifying material is included in the dielectric beforehand, the cut amount of the metallic material block can be decreased and the amount of the metallic material electrically discharged with the tool can be reduced substantially. Further, a material excellent in electrical discharge performance, such as copper, can be used as the metallic material block, thereby providing an electrical discharge machining-basis surface treatment apparatus in which electrical discharge machining is stabilized and which can carry out more stable surface treatment. Also, an electrical discharge machining electrode complicated in shape can be surface modified easily.

It will also be apparent that the present invention achieves a surface treatment apparatus which comprises holding means for holding a rotary cutting tool or an electrical discharge machining electrode, a rotating device for holding a metallic material block opposite to said rotary cutting tool or electrical discharge machining electrode and rotating said metallic material block on the axis of said rotary cutting tool or electrical discharge machining electrode, dielectric supplying devices for supplying a dielectric including modifying material powder between said rotary cutting tool or electrical discharge machining electrode and said metallic material block, a driving mechanism for relatively moving said rotary cutting tool or electrical discharge machining electrode and said metallic material block, and an electrical discharge machining power supply for applying a voltage between said rotary cutting tool or electrical discharge machining electrode and said metallic material block, and when the rotary cutting tool is rotated, which performs a rotary motion by means of said rotating device and relative movement by means of said driving mechanism to cut the metallic material block by means of said rotary cutting tool and supplies the dielectric including the modifying material and simultaneously generates electrical discharge between the cutting edges of said rotary cutting tool and said metallic material block to form the modification layer on the cutting edges of said rotary cutting tool, whereby the cutting edges of a cutting tool complicated in shape can be surface modified by a simple apparatus, and as a result, tool surface treatment to increase a cutting tool life greatly can be carried out. Also, since the modifying material is included in the dielectric beforehand, the cut amount of the metallic material can be decreased and the amount of the metallic material block electrically discharged with the tool can be reduced substantially. Also, a material excellent in electrical discharge performance, such as copper, can be used as the metallic material block, whereby electrical discharge machining is stabilized and more stable surface treatment can be carried out. Further, the modifying material is rotated as in a lathe, whereby an easier, lower-priced electrical discharge machining-basis surface treatment apparatus can be provided. Also, an electrical discharge machining electrode complicated in shape can be surface modified easily.

It will also be apparent that the present invention achieves a surface treatment apparatus which carries out surface treatment while simultaneously changing and controlling the relative travel speed, rotary speed or relative rotary speed of the rotary cutting tool according to an electrical discharge machining amount, whereby in addition to said effects, efficient surface treatment can be conducted and the modification layer can be changed in thickness.

It will further be apparent that the present invention achieves a surface treatment apparatus which controls the relative travel speed, rotary speed or relative rotary speed of said rotary cutting tool to keep the ratio of cutting to electrical discharge machining at a predetermined value, whereby in addition to said effects, an even modification layer can be provided if the tool is different in shape and size.

The entire disclosure of each and every foreign patent application from which the benefit of foreign priority has been claimed in the present application is incorporated herein by reference, as if fully set forth.

Although this invention has been described in at least one preferred embodiment with a certain degree of particularity, it is to be understood that the present disclosure of the preferred embodiment has been made only by way of example and that numerous changes in the details and arrangement of components may be made without departing from the spirit and scope of the invention as hereinafter claimed.

What is claimed is:

1. A method for surface treatment by electrical discharge machining for forming a modification layer on a metal surface by electrical discharge machining, said method comprising:

relatively rotating a modifiable cutting tool to be surface modified and a block of conductive material;

providing a modifying material to an interface between said block and said modifiable cutting tool; and generating electrical discharge between said block and said modifiable cutting tool to form a modification layer on the surface of said modifiable cutting tool.

2. The method as recited in claim 1 wherein said providing step comprises including a modifying material in said block.

3. The method for surface treatment by electrical discharge machining as defined in claim 2, wherein said cutting tool is a rotary cutting tool and in a first process, a cutting step and said electrical discharge machining step are alternated to form the modification layer on the cutting edges of the rotary cutting tool; and in a second process subsequent to said first process cutting is only carried out to grind the cutting edges of said rotary cutting tool.

4. The method as recited in claim 1 wherein said providing step comprises providing a dielectric including said modifying material to said interface concurrent with at least a portion of said discharge generating step.

5. The method as recited in claim 4 wherein said dielectric providing step comprises at least one of bathing said block and said cutting tool in dielectric or spraying dielectric including said modifying material powder onto said interface.

6. The method as recited in claim 3 wherein said block is a metallic material block.

7. The method of claim 1 wherein said modifying material comprises a ceramic.

8. A method for surface treatment by electrical discharge machining for forming a modification layer on a metal surface by electrical discharge machining, said method comprising:

rotating at least one of a rotary cutting tool having cutting edges and a block including a modifying material and relatively moving said block including the modifying material and said rotary cutting tool to cut said block including the modifying material by means of said rotary cutting tool; and generating an electrical discharge between said cutting edges of said cutting tool and said block including the modifying material to form a modification layer on said cutting edges of said rotary cutting tool.

9. The method of claim 8 wherein said modifying material comprises a ceramic.

10. The method for surface treatment by electrical discharge machining as defined in claim 8, wherein in a first process, said cutting step and said electrical discharge machining step are alternated to form the modification layer on the cutting edges of the rotary cutting tool; and in a second process subsequent to said first process cutting is only carried out to grind the cutting edges of said rotary cutting tool.

11. A method for surface treatment by electrical discharge machining for forming a modification layer on a metal surface by electrical discharge machining, said method comprising rotating a rotary cutting tool or a metallic material block and relatively moving the metallic material block and the rotary cutting tool to cut said metallic material block by means of said rotary cutting tool, and supplying a dielectric including modifying material powder and simultaneously generating electrical discharge between the cutting edges of said rotary cutting tool and said metallic material block to form a modification layer on the cutting edges of said rotary cutting tool.

12. The method for surface treatment by electrical discharge machining as defined in claim 11, wherein a ceramic-based material is employed as said modifying material.

13. The method for surface treatment by electrical discharge machining as defined in claim 11, wherein cutting and electrical discharge machining are alternated to form the modification layer on the cutting edges of the rotary cutting tool and subsequently cutting is only carried out to grind the cutting edges of the rotary cutting tool.

14. An apparatus for surface treatment by electrical discharge machining for forming a modification layer on a metal surface by electrical discharge machining, said apparatus comprising:

a block, including a tool modifying material;

rotating means for holding a rotary machining tool, comprising one of a rotary cutting tool or an electrical discharge machining electrode, and rotating said held rotary machine tool;

fixing means for fixing said block including the modifying material opposite to said rotary machining tool;

a driving mechanism for relatively moving said rotating machining tool and said block including the modifying material; and an electrical discharge machining power supply means for selectively applying a voltage between said rotary machining tool and said block including the modifying material.

15. An apparatus for surface treatment by electrical discharge machining for forming a modification layer on a metal surface by electrical discharge machining, said apparatus comprising:

rotating means for holding a rotary machining tool, comprising one of a rotary cutting tool or an electrical discharge machining electrode, and rotating said held rotary machine tool;

fixing means for fixing a block including a modifying material opposite to said rotary machining tool;

a driving mechanism for relatively moving said rotating machining tool and said block including the modifying material;

an electrical discharge machining power supply means for selectively applying a voltage between said rotary machining tool and said block including the modifying material; and control means for changing and controlling at least one of the relative travel speed, rotary speed or relative rotary speed of said rotary machining tool according to an electrical discharge machining amount.

16. The apparatus for surface treatment by electrical discharge machining as defined in claim 15, wherein said rotary machining tool is a cutting tool and said control means is operative to control said relative travel speed, rotary speed or relative rotary speed of said rotary cutting tool in order to keep the ratio of cutting to electrical discharge machining at a predetermined value.

17. An apparatus for surface treatment by electrical discharge machining for forming a modification layer on a metal surface by electrical discharge machining, said apparatus comprising:

a block including a tool modifying material;

means for holding a machining tool having an axis, said tool comprising a rotary cutting tool for cutting or an electrical discharge machining electrode for electrical discharge machinery;

rotating means for holding said block including the modifying material opposite to said machining tool and for rotating said block including the modifying material on the axis of said machining tool;

a linear driving mechanism for relatively moving said machining tool and said block including the modifying material; and an electrical discharge machining power supply means for selectively applying a voltage between said machining tool and said block including the modifying material, including voltage to effect electrical discharge machining.

18. The apparatus for surface treatment by electrical discharge machining as defined in claim 17, further comprising a control means for controlling at least one of the relative travel speed, rotary speed or relative rotary speed of said machining tool according to an electrical discharge machining amount.

19. The apparatus for surface treatment by electrical discharge machining as defined in claim 18, wherein said control means is operative to provide cutting and electrical discharge machining at a predetermined ratio.

20. An apparatus for surface treatment by electrical discharge machining for forming a modification layer on a metal surface of a machining tool by electrical discharge machining, said apparatus comprising:

rotating means for holding said machining tool, comprising one of a rotary cutting tool for cutting or an electrical discharge machining electrode for electrical discharge machining, and for rotating said machining tool about a tool axis;

fixing means for fixing a metallic material block opposite to said machining tool;

dielectric supplying means for supplying a dielectric including modifying material powder between said machining tool and said metallic material block;

a driving mechanism for further relatively moving said rotary machining tool and said metallic material block; and an electrical discharge machining power supply for applying a voltage between said machining tool and said metallic material block, including a voltage to effect electrical discharge machining and modification of said machining tool.

21. The apparatus for surface treatment by electrical discharge machining as defined in claim 20, further comprising a control means for controlling at least one of the relative travel speed, rotary speed or relative rotary speed of said machining tool according to an electrical discharge machining amount.

22. The apparatus for surface treatment by electrical discharge machining as defined in claim 21, wherein said control means is operative to provide cutting and electrical discharge machining at a predetermined ratio.

23. An apparatus for surface treatment by electrical discharge machining for forming a modification layer on a metal surface of a machining tool by electrical discharge machining, said apparatus comprising:

holding means for holding said machining tool having an axis, said tool comprising at least one of a rotary cutting tool for cutting and an electrical discharge machining electrode for electrical discharge machining;

a rotating device for holding a metallic material block opposite to said machining tool and rotating said metallic material block on the axis of said rotary cutting tool or electrical discharge machining electrode;

dielectric supplying devices for supplying a dielectric including modifying material powder between said machining tool and said metallic material block;

a driving mechanism for relatively moving said machining tool and said metallic material block; and an electrical discharge machining power supply for applying a voltage between said machining tool and said metallic material block, including a voltage to effect electrical discharge machining and modification of said machining tool.

24. The apparatus for surface treatment by electrical discharge machining as defined in claim 23, further comprising a control means for controlling at least one of the relative travel speed, rotary speed or relative rotary speed of said machining tool according to an electrical discharge machining amount.

25. The apparatus for surface treatment by electrical discharge machining as defined in claim 24, wherein said control means is operative to provide cutting and electrical discharge machining at a predetermined ratio.

* * * * *